United States Patent [19]

Paquette

[11] Patent Number: 4,702,473

[45] Date of Patent: Oct. 27, 1987

[54] COMBINATION HAND WEIGHT AND WATER DISPENSER

[76] Inventor: Daniel Paquette, 3132 Desautels, Montreal (Quebec), Canada, H1N 3B7

[21] Appl. No.: 875,566

[22] Filed: Jun. 18, 1986

[30] Foreign Application Priority Data

Jun. 24, 1985 [GB] United Kingdom ..... 8515969

[51] Int. Cl.[4] ..... A63B 21/12; B65D 37/00

[52] U.S. Cl. ..... 272/117; 272/DIG. 9; 222/210; 222/212; 350/98; D9/378

[58] Field of Search ..... 272/DIG. 9, 68, 67, 272/117, 222, 70; 40/542, 586, 582; 135/65, 67; 215/1 R; 222/455 R, 323, 210, 192, 212, 175; 350/98; D9/378, 382, 373, 447; D12/104

[56] References Cited

U.S. PATENT DOCUMENTS

| | | | |
|---|---|---|---|
| D. 276,890 | 12/1984 | Hancher | D9/378 |
| 2,198,082 | 4/1940 | Harty | 350/98 |
| 2,783,919 | 3/1957 | Ansell | D9/447 |
| 3,157,323 | 11/1964 | Kitterman | 222/212 X |
| 3,232,495 | 2/1966 | Schneider | 222/210 X |
| 4,079,932 | 3/1978 | Schuetz | 272/75 |
| 4,218,057 | 8/1980 | Wilson | 272/117 |
| 4,229,015 | 10/1980 | Ramsey | 135/66 |
| 4,312,567 | 1/1982 | Sklair | 350/98 |
| 4,351,526 | 9/1982 | Schwartz | 272/119 |
| 4,517,685 | 5/1985 | Lesley | 350/98 |
| 4,575,074 | 3/1986 | Damratoski | 272/122 |

FOREIGN PATENT DOCUMENTS

| | | | |
|---|---|---|---|
| 2525473 | 12/1976 | Fed. Rep. of Germany . | |
| 985908 | 3/1951 | France | 272/68 |

OTHER PUBLICATIONS

Die Umsatzrakete Von, Spiel Sport, Ausgegeben am, Jun. 3, 1909, No. 585.

*Primary Examiner*—Richard J. Johnson
*Attorney, Agent, or Firm*—Robic, Robic & Associates

[57] ABSTRACT

A combination hand weight and water dispenser has a hollow D-shaped watertight body with a straight portion, suitable to be hand gripped by the user; a water filling and discharging aperture, and a teat drinking assembly screwed around the aperture. The combination allows easy filling of the hollow body and withdrawing of water when the teat assembly is operated by the mouth of the user.

6 Claims, 3 Drawing Figures

COMBINATION HAND WEIGHT AND WATER DISPENSER

The present invention relates to a combination hand weight and water dispenser for use particularly by long distance runners and joggers both as a hand weight to exercise the arm muscles as well as a reserve of water from which the user can draw to quench his thirst.

The combination hand weight and water dispenser, according to the invention, is intended for use by road or long distance runners as well as joggers or short distance runners.

The importance of drinking water during a physical activity requiring a sustained effort, such as foot racing, is of course well known. Water bottles are required in the practice of all sports, be they hockey, football, bicycling or the like. However, there does not exist, at the moment, any easy way for a foot runner to drink water while running unless drinking points are provided along the road, which is the case only where officially controlled races are concerned.

The present invention avoids the above inconvenience by providing water-filled hand weighs that allow both exercising the arm muscles as well as being a source of drinking water available while running. Furthermore, the hand weight becomes lighter as water is withdrawn, allowing the arm muscles to relax after becoming tired.

Another important advantage of the water-filled and weight of the invention is that the user is able to select and control the quality of the water or, for that matter, of any other liquid he may choose to drink. This is of course not the case where water is available only at selected water dispensing points along the road.

A description now follows of a preferred embodiment of the invention having reference to the appended drawing wherein.

Figure 1:
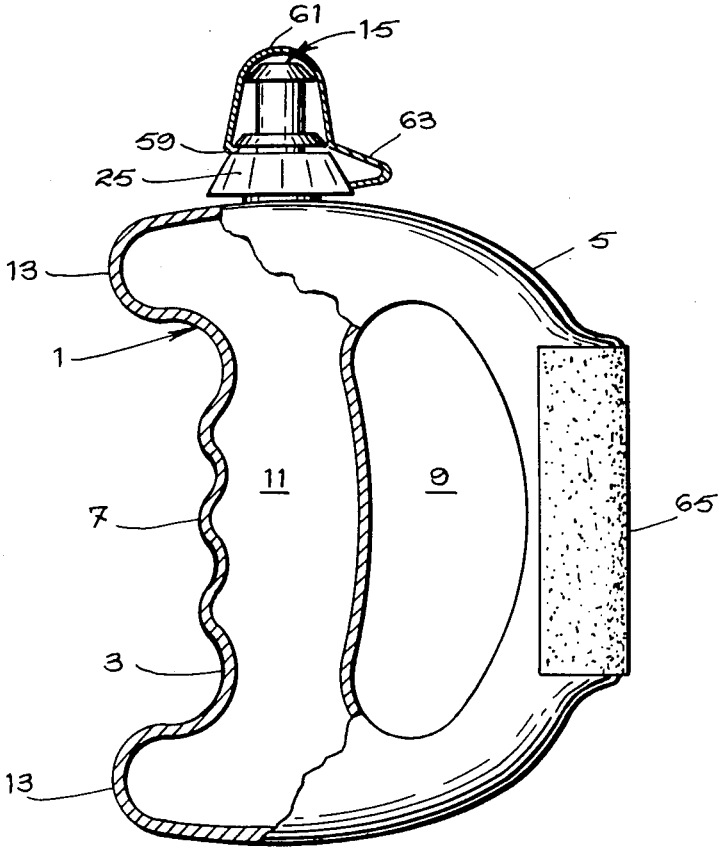
FIG. 1 is a side elevation view, partly shown in cross-section, of a combination made according to the teaching of the present invention.

The combination illustrated in the drawing comprises a hollow watertight D-shaped body 1 intended to contain water and including a straight portion 3 and a likewise hollow arcuate portion 5 integrally joining the straight portion 3 at the adjacent ends of the portions. The forward face of the straight portion 3 may have a wavy configuration for the insertion of fingers to provide a strong grip on the hand weight and water dispenser combination. It will be noted that a space 9 is left between the portions 3 and 5 for the insertion of the palm of the hand of a user. As said before, both portions 3 and 5 are hollowed out throughout to create an unobstructed inner water reservoir 11. In order to increase the water holding capacity of the inner reservoir 11, the arcuate portion 5 may have laterally extending hollow portions 13 at their ends which project away from the straight portion 3, with respect to the arcuate portion 5.

Figure 2:
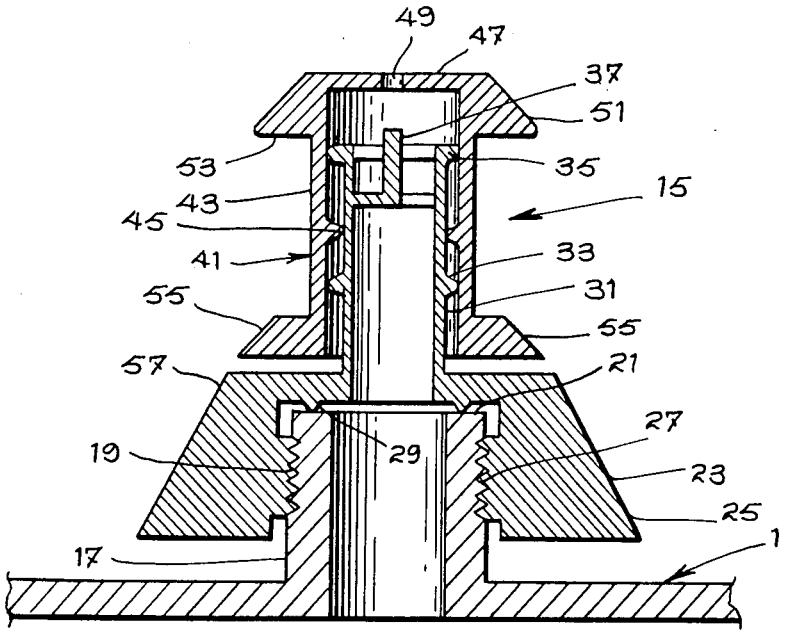
FIG. 2 is a cross-sectional view of one type of water drinking means.

As aforesaid, the combination of the invention is that of a hand weight, as just described, and of a water dispenser 15 illustrated in cross-section in FIG. 2. Dispenser 15 more specifically comprises a water filling and discharging aperture means in the form of a cylindrical neck 17, outwardly threaded at 19, and terminating into a flat annular transverse shoulder 21. Water drinking means 23 are removably mounted on the aperture means 19, 21, aforedescribed. Water drinking means 23 comprise a cap portion 25 with inward threads 27 which can mesh with the threads 19 so that the water drinking means 23 may be removed and placed over the neck 17. To ensure proper tightness, a circular rim 29 may be provided at the bottom of the generally cup-shaped cap portion 25, the rim 29 sitting tightly over the shoulder 21 when the cap portion 25 is screwed down.

An open-ended cylindrical tube 31 upstands from the bottom of the cap portion 23 and is formed, outwardly thereof, with two spaced outwardly projecting circular pointed beads 33, 35. A hole-plugging pin 37 is provided within the tube 31, at one end thereof, and is made solid therewith by means of three short cross-braces 39. The braces 39 are spaced apart to allow free flow of water. It will be noted also that the hole-plugging pin 37 projects slightly above the upper end of the tube 31.

The water drinking means 23 has a cup-shaped closure 41 having a tubular skirt 43 provided with an annular inward pointed bead 45 intended to be pressed against the tube 31, between its pointed beads 33, 35. The bottom 47 of the closure 41 is formed, at its center, with a through hole 49 of which the diameter corresponds to that of the hole plugging pin 37. The upper end of the closure 41 terminates into an annular bulge 51 defining a radial shoulder 53.

The diameter of the circular beads 33, 35, of the tube 31 is selected such as to be press fitted against the bore of the tubular skirt 43. Likewise, the inward bead 45 of the same skirt 43 pressingly engages the outer surface of the tube 31. These press fits are selected so that the closure 41 will not freely slide along the tube 31 yet weak enough so that the closure can be moved by the mouth of a user when he engages the shoulder 53 and bottom 47 of the closure 41 to move the latter either up or down. In moving it down, the tip of the pin 37 is eventually force-fitted into the hole 49 so that the water dispenser 15 is in closure position. By moving the closure 41 upwardly, the hole 49 is of course released and water may flow out therethrough.

As shown in FIG. 1, the water filling and discharging aperture means 15 is preferably located at one end of the straight body portion 3. Here, the outward bulge 51 shown in FIG. 2, may have a spherical configuration.

Referring again to FIG. 2, the lower end of the tubular skirt 43 may terminate into a radially projecting ledge 55 intended to sit over the bottom 57 of the cap portion 25.

On the other hand, the ledge 55 may terminate short of the bottom 57, as shown in FIG. 1, to allow for the insertion of a locking insert 59 provided at the lower end of a protection cap 61, a flexible tongue 63 being provided opposite the locking insert 59. The free ends of this flexible tongue 63 are secured respectively to the lower end of the cap 61 and to the cap portion 25.

Figure 3:
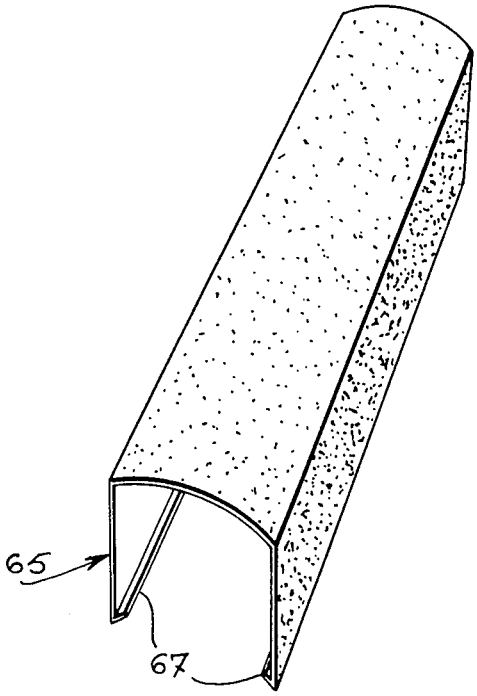
FIG. 3 is a perspective view of a light reflector member.

As shown in FIGS. 1 and 3, the combination may appropriately and advantageously comprise a U-shaped light reflector member 65 of which the free ends of the legs are inwardly turned as at 67 so that the reflector 65 may be press-mounted on the hollow arcuate portion 5 of the body 1, as shown in FIG. 1. The inward turn 67 then act as biassing members. This reflector member is a preferred safety member when the user jogs at night as he may easily be picked up by motor vehicle drivers.

I claim:

1. Combination hand weight and water dispenser for distance runners or joggers, said combination comprising:

a hollow watertight body containing water and including: elongated straight hollow portion and an arcuate hollow portion integrally joining said straight portion at adjoining ends of said portions whereby to form an essentially D shape; said portions inwardly communicating together to provide a water reservoir and defining, therebetween outwardly of said body, a space suitable for the insertion of the hand of a user and of a size to substantially conform thereto;

finger grip means adapted to conform to the hand of a user on said straight portion on a face thereof opposite said hand insertion space, and mouth-operable water dispensing value means at one end of said straight body portion, essentially coaxial therewith.

2. A combination as claimed in claim 1, wherein said water dispensing means comprise:

water filling and discharging aperture means solid and essentially coaxial with said straight body portion at said one end thereof, and water drinking means cooperatively mounted on said aperture means and including water dispensing valve closure means operable by the mouth of the user for allowing selective drawing of water from said body and preventing water flow out of said body.

3. A combination as claimed in claim 2, wherein said finger gripping means are defined by a wavy configuration extending lengthwise of said straight portion.

4. A combination as claimed in claim 3, wherein said arcuate portion extends beyond said straight portion, with respect to said palm insertion space, to increase the water holding capacity of said water reservoir.

5. A combination as claimed in claim 2, further comprising: a U-shaped light-reflector member press-mounted on said hollow arcuate portion of said body.

6. A combination hand weight and water dispenser, comprising:

a hollow watertight body intended to contain water and including a straight portion suitable for the combination to be gripped by the hand of a user;

water-filling and discharging aperture means on said body; and water drinking means mounted on said aperture means and including teat means operative by the mouth of the user to allow selective drawing of water out of said body and preventing water from flowing out of said body;

wherein said body further includes a hollow arcuate portion integrally joining said straight portions at adjacent ends of said arcuate and straight portions to form an essentially D-shape therewith, said portions inwardly communicating with one another to provide a water reservoir, said portions additionally defining a space outwardly therebetween for the insertion of the hand of the user and of a size to substantially conform thereto;

wherein said water filling and discharging aperture means is solid with one end of said straight body portion; and wherein said combination further comprises a U-shaped light reflector member press-mounted on said hollow arcuate portion of said body.

* * * * *